United States Patent [19]

Sawazaki

[11] Patent Number: 4,570,460

[45] Date of Patent: Feb. 18, 1986

[54] WARP FEEDING DEVICE FOR CIRCULAR KNITTING MACHINE

[75] Inventor: Masatoshi Sawazaki, Kobe, Japan

[73] Assignee: Precision Fukuhara Works, Ltd., Kobe, Japan

[21] Appl. No.: 732,051

[22] Filed: May 9, 1985

[30] Foreign Application Priority Data

May 18, 1984 [JP] Japan ..... 59-101345

[51] Int. Cl.[4] ..... D04B 9/32; D04B 15/60

[52] U.S. Cl. ..... 66/135

[58] Field of Search ..... 66/125 R, 135, 139, 66/13, 31

[56] References Cited

U.S. PATENT DOCUMENTS 2,637,988 5/1953 Striar ..... 66/135
3,530,688 9/1970 Lombardi ..... 66/135
3,832,867 9/1974 Luchi ..... 66/13
3,995,454 12/1976 Hayashi et al. ..... 66/135
3,995,455 12/1976 Hayashi et al. ..... 66/135

*Primary Examiner*—Ronald Feldbaum
*Attorney, Agent, or Firm*—Bell, Seltzer, Park & Gibson

[57] ABSTRACT

The present feeding device operates to wrap walewise extending yarns about selected groups of needles of a circular knitting machine. First and second cooperating sliders are supported for radial sliding movement in radial slots in a dial coaxial and rotatable with the needle cylinder. A yarn wrapping arm is pivotally supported on the second slider for movement in a radial path across the needle circle. The first slider is operative to move the wrapping arm in an arcuate path about its axis. Pattern cams are provided in the dial for imparting such movement to the first and second sliders.

9 Claims, 14 Drawing Figures

WARP FEEDING DEVICE FOR CIRCULAR KNITTING MACHINE

FIELD OF THE INVENTION

This invention relates generally to a warp feeding device for circular knitting machines and more particularly to such a device for wrapping walewise extending wrap yarns about selected groups of needles to form patterns extending in the walewise direction of the weft knit fabric.

BACKGROUND OF THE INVENTION

It is generally known to feed wrap yarn to selected groups of needles in a circular knitting machine to form walewise extending patterns in tubular weft knit fabric. For example, such a wrap yarn feeding device is disclosed in Japanese Patent Application No. 57-143548. According to this publication, the yarn wrapping device includes a plurality of pivotally supported levers with a yarn guide positioned in the outer end of one leg of each pivoted lever. An opposite leg extends inwardly and in the opposite direction from the yarn guide leg. A rotation mechanism is provided with first and second projections with the first projection being positioned in the path of travel of the yarn guiding leg to pivot the pivoted lever from a nonoperating position with the yarn being positioned inside of the knitting needles to an operating position with the yarn passing through and to the outside of the knitting needles. The second projection is located in a position for engaging the second leg of the pivoted lever to return the same to the nonoperating position. This arrangement of pivoted levers requires a relatively wide space between the levers for pivoting movement so that it is not possible to form closely spaced wrap patterns. Also, the arcuate path of movement of the pivoted wrap yarn lever is fixed so that the possibility of forming a variety of different knitting patterns is severely limited.

SUMMARY OF THE INVENTION

With the foregoing in mind, it is an object of the present invention to provide a wrap yarn feeding device for a circular knitting machine which is capable of knitting wrap patterns positioned close to each other in the walewise direction.

It is another object of the present invention to provide a wrap yarn feeding device which is supported for both radial movement across the needles and for arcuate movement relative to the needles so that a wide variety of wrap patterns can be formed with the present wrap yarn feeding device.

The wrap yarn feeding device of the present invention includes a radially slotted dial which is coaxial and rotatable with the needle cylinder. First and second cooperating sliders are supported for radial sliding movement in each of the slots of the dial and a yarn wrapping arm has its inner end pivotally supported about a vertical axis on the outer end of the second slider. The outer end of the wrapping arm includes yarn guide means to receive and wrap the yarn about a selected group of the cylinder needles. Pattern means is provided in the dial for imparting inward and outward radial movement to the second slider to move the wrapping arm in a radial path of travel extending across the needle circle. The pattern means is also operable to move the first slider in an inward and outward radial path of movement to impart an arcuate path of movement to the wrapping arm relative to the needle circle. The first and second sliders are provided with operating butts and operating cams are provided in the dial for engagement with the operating butts of the first and second sliders to control the relative radial positions thereof.

Several embodiments are illustrated for operatively connecting the second slider to the wrapping arm for imparting arcuate movement thereto. In one illustrated embodiment, a fixed pin is supported at one end by the wrapping arm and extends through an elongated hole provided in the front or outer portion of the second slider. A recess is formed in the outer end of the first slider and the pin extends into the recess so that radial movement of the first slider imparts arcuate movement to the wrapping arm.

In another embodiment, the first slider is positioned between the second slider and the wrapping arm for radial sliding movement. An operating pin is fixed in the yarn wrapping arm and extends through a hole in the first slider and an elongated slot in the second slider so that radial movement of the first slider imparts arcuate movement to the wrapping arm.

In a third illustrated embodiment a vertically disposed operating pin extends through a horizontal slot in the wrapping arm. The outer end of the first slider is provided with a horizontal projection including a medial groove therein so that the vertical operating pin is positioned in the groove. Radial movement of the first slider, relative to the second slider, imparts arcuate movement to the wrapping arm.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENTS

Figure 1:
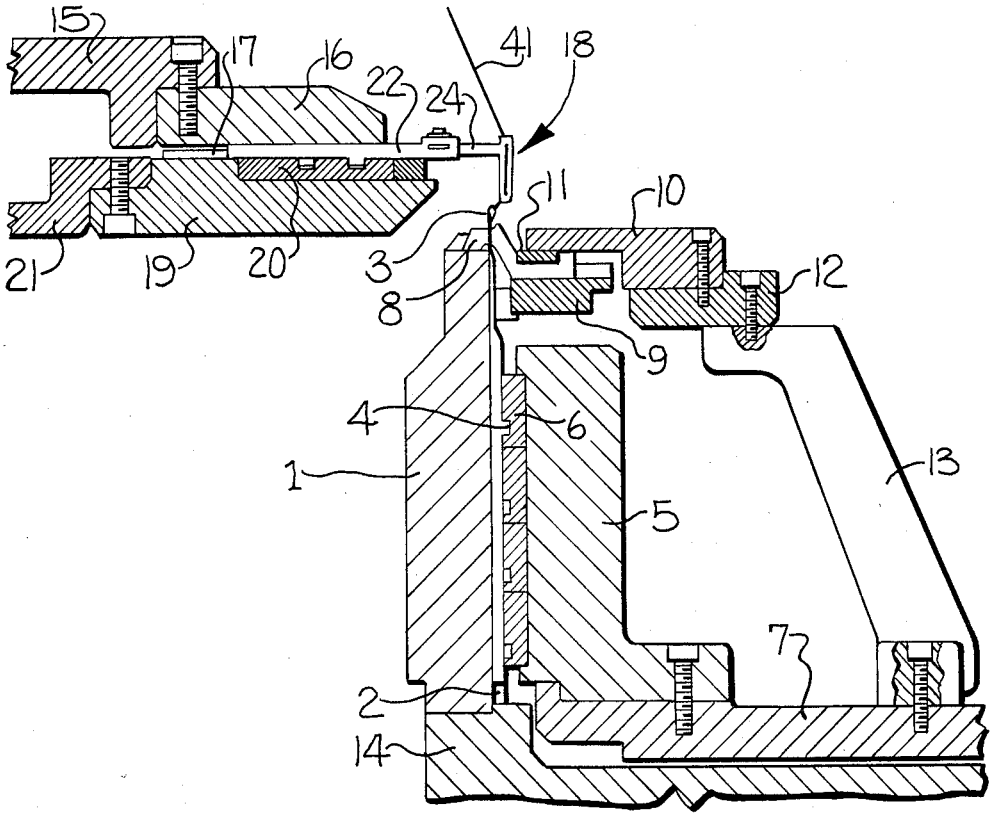
FIG. 1 is a fragmentary vertical sectional view through the needle cylinder and illustrating the present wrap yarn feeding device associated therewith.

As illustrated in FIG. 1, the knitting machine includes a rotatable needle cylinder 1 provided with vertically extending grooves 2 in which knitting needles 3 are supported for vertical sliding movement. The vertical position of each of the needles 3 is controlled by one or more actuating butts 4 positioned thereon. Suitable cams 6 are provided for engaging the actuating butts 4 and controlling the vertical position of the needles 3. The cams 6 are supported in a cam holder bracket 5 supported on a fixed cam ring 7.

Sinkers 8 are supported for radial sliding movement in a sinker dial 9 and are controlled by a sinker cam 11 supported on the sinker cap 10 for cooperating with the needles 3 in the knitting operation. The sinker cap 10 is fixed on a sinker cap ring 12 which is in turn supported by spaced apart support brackets 13 disposed at equal intervals around and on the cam ring 7. A driving gear 14 is secured to the lower portion of the needle cylinder 1 and is driven by conventional drive means of the knitting machine, not shown.

The wrap yarn feeding device of the present invention includes a slider dial support disk 15 which is coaxial with the needle cylinder 1 and rotates therewith. A slider dial 16 is fixed for rotation on the supporting disk 15 and the lower surface of the slider dial 16 is provided with radially extending slider grooves 17. A wrap yarn feeder, broadly indicated at 18, is supported for horizontal and radial sliding movement in each of the slider grooves 17. Pattern means, in the form of slider cams 20, is supported on a slider cam holder 19 disposed below the slider dial 16. The slider cam holder 19 is fixed to a supporting disk 21 which is supported in a fixed position inside of the needle cylinder 1.

Figure 2:
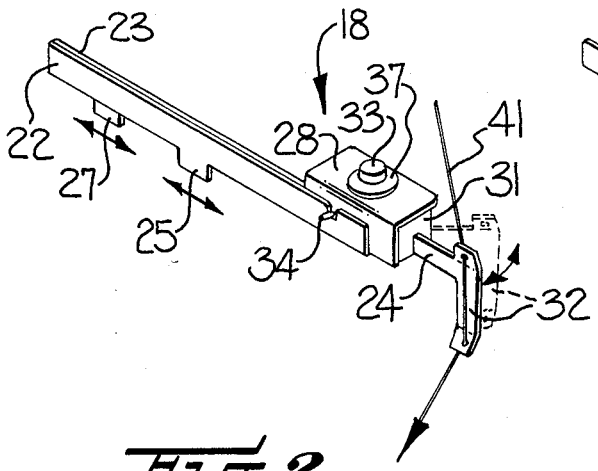
FIG. 2 is an isometric view of a first embodiment of wrap yarn feeding device in accordance with the present invention.
Figure 3:
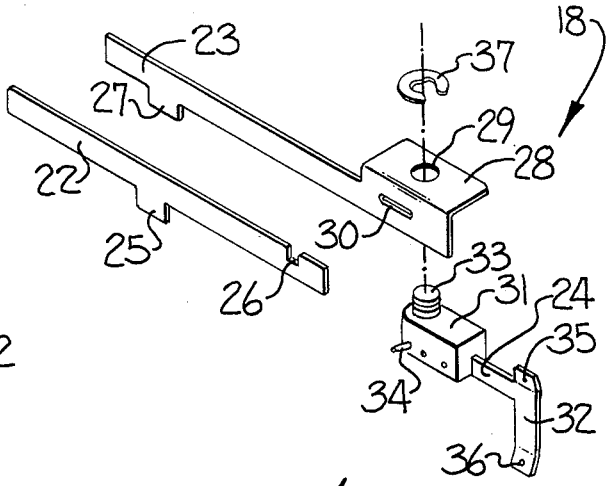
FIG. 3 is a view similar to FIG. 2 but showing the parts in exploded condition.

A first embodiment of the wrap yarn feeder 18 is illustrated in FIGS. 2 and 3 and includes a first slider 22 and a second slider 23 which are both supported in the same radial groove 17 for radial sliding inward and outward movement. The first slider 22 is provided with a downwardly extending actuating butt 25 and a recess 26 is positioned adjacent the upper edge of the outer end thereof.

The second slider 23 is provided with a downwardly extending actuating butt 27 which, as illustrated in FIG. 2, is out of alignment and spaced from the butt 25 of the first slider 22. A horizontal slot 30 is provided in the outer end portion of the stem of the second slider 23 and a horizontally extending support plate 28 is integrally formed with the outer portion of the slider 23. A vertical pivot hole 29 is formed in the medial portion of the support plate 28 for pivotally supporting a wrapping arm 24.

The inner end of the wrapping arm 24 is fixed in a pivot block 31 and the outer end is provided with a yarn guide 32. A pivot shaft 33 is fixed at its lower end in the inner end of the support pivot block 31 and extends upwardly through the pivot hole 29 and is maintained in position by a snap lock ring 37. The inner end of a control pin 34 is fixed in the side of the support block 31 and projects through the slot 30 and into the operating notch or recess 26 in the outer end of the first slider 22. The outer end of the yarn guide 32 is provided with respective upper and lower yarn guide openings 35, 36 to receive and to wrap yarn, as indicated at 41, about a selected group of needles and to thereby form a warp yarn pattern in the knit fabric.

When the first and second sliders 22, 23 are simultaneously moved in a radial direction, the wrapping arm 24 is maintained in a fixed position. However, when inward or outward movement is imparted to the first slider 22 while the second slider 23 is maintained in a fixed radial position, arcuate pivotal movement is imparted to the wrapping arm 24, as indicated by the arrows in FIG. 2, and in the direction corresponding to the movement of the first slider 22 relative to the second slider 23.

Figure 4:
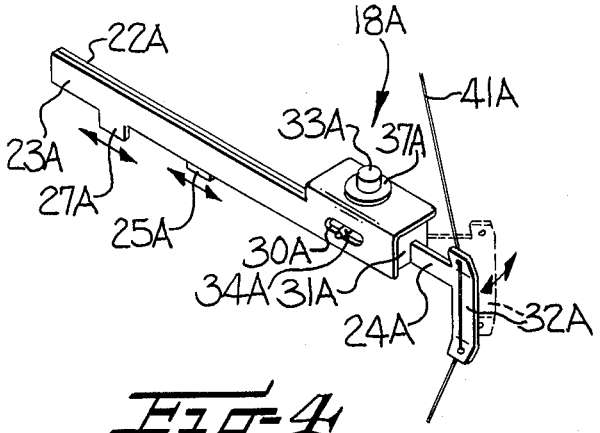
FIG. 4 is an isometric view of a second embodiment of the wrap yarn feeding device of the present invention.
Figure 5:
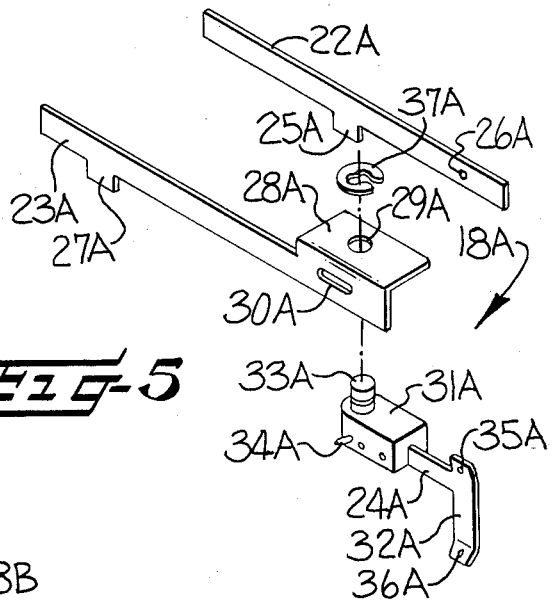
FIG. 5 is a view similar to FIG. 4 but showing the parts in exploded condition.

A second embodiment of the wrap yarn feeding device of the present invention is illustrated in FIGS. 4 and 5. This second embodiment is substantially identical to the first embodiment of FIGS. 2 and 3 except that the relative positions of the first and second sliders are reversed from the relative positions illustrated in FIGS. 2 and 3. Reference characters for those parts which are the same as the corresponding parts in FIGS. 2 and 3 will bear the same references characters with the suffix "A" added thereto.

In this second embodiment, it will be noted that the first slider 22A is positioned behind the second slider 23A. Also, the outer end of the slider 22A is provided with a horizontal hole 26A, rather than the recess 26, as shown in FIG. 3. In this embodiment, the control pin 34A passes through the operating hole 26A in the first slider 22A and through the slot 30A in the outer end of the second slider 23A. The remaining parts and operation of the embodiment of FIGS. 4 and 5 are identical to the embodiment of FIGS. 2 and 3.

Figure 6:
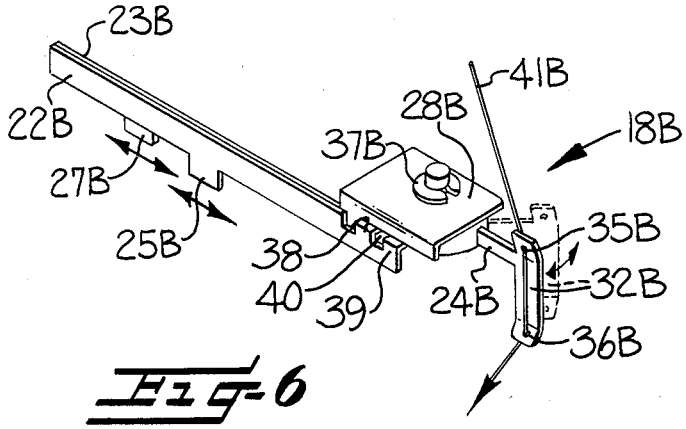
FIG. 6 is an isometric view of a third embodiment of the wrap yarn feeding device of the present invention.
Figure 7:
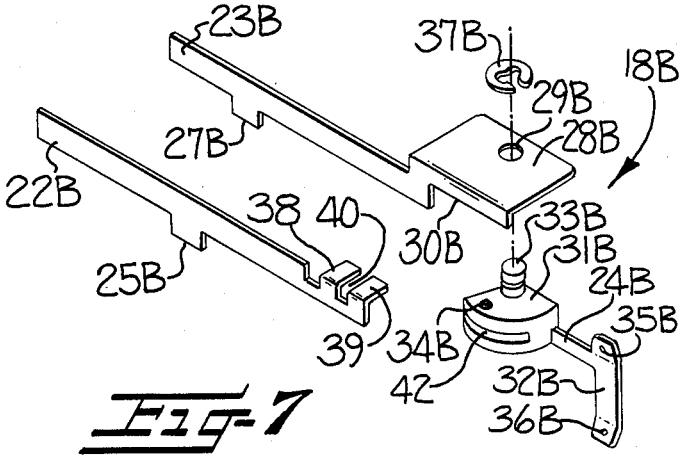
FIG. 7 is a view similar to FIG. 6 but showing the parts in exploded condition.

A third embodiment of the wrap yarn feeder is illustrated in FIGS. 6 and 7 and the parts of this third embodiment which correspond with parts in the first embodiment will bear like reference characters with the suffix "B" added thereto. As clearly illustrated in FIG. 7, the outer end of the first slider 22B is provided with a horizontally extending portion defining a pair of projections 38, 39 with a groove 40 interposed therebetween. The outer end of the second slider 23B is provided with a cut-out portion 30B spaced below the horizontal support plate 28B. The side portion of the pivot support block 31B is provided with a horizontal slot or groove 42 and the control pin 34B is supported in a vertical position and passes through the slot 42. When assembled, as illustrated in FIG. 6, the projections 38, 39 of the first slider 22B straddle the control pin 34B within slot 40 so that inward and outward radial movement of the first slider 22B, relative to the second slider 23B, imparts arcuate swinging movement to the wrapping arm 24B, as indicated by the arrows, and between the solid and dash-dot line positions shown in FIG. 6.

METHOD OF OPERATION

The operation of the present wrap yarn feeding device will be described with particular reference to the first embodiment of the wrap yarn feeder 18, as illustrated in FIGS. 8 through 14. However, it is to be understood that the second embodiment of FIGS. 4 and 5 and the third embodiment of FIGS. 6 and 7 will operate in an identical manner in wrapping walewise extending wrap yarns about selected groups of needles of the circular knitting machine.

Figure 8:
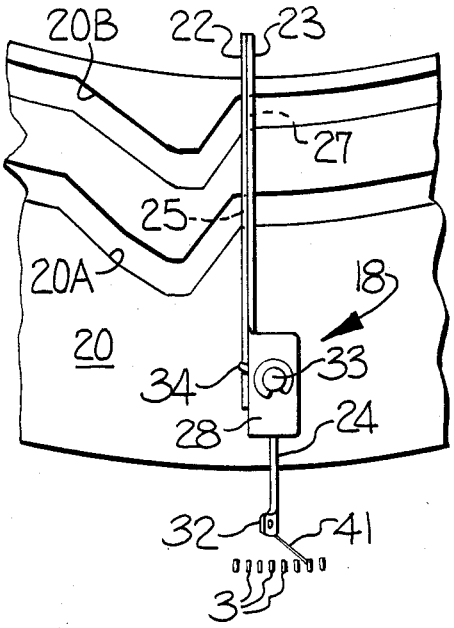
FIGS. 8 through 12 are somewhat schematic plan views illustrating the successive steps in operation of the wrap yarn feeding device and illustrating the manner in which the first and second sliders operate to radially move the wrapping arm across the needle circle and to have the wrapping arm in an arcuate path relative to a selected group of needles.
Figure 9:
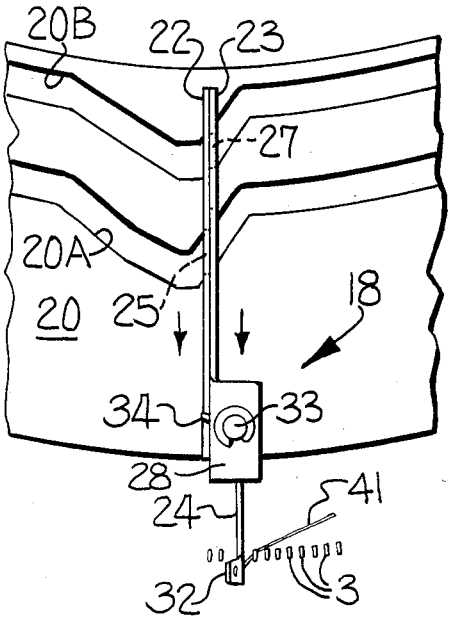

As shown in FIG. 8, the first and second sliders 22, 23 are positioned in their rearmost or innermost positions with their respective butts 25, 27 moving along substantially straight portions of respective cam tracks 20A and 20B of the cams 20. The outermost end of the wrapping arm 24 is positioned in substantial alignment with the sliders 22, 23 and inside of the circle of knitting needles 3. The wrap yarn 41 is guided inwardly to the yarn guide 32 and inwardly of the needles 3 from the last needle to knit the wrap yarn. With further rotation of the slider dial 16, the butts 25, 27 of the respective sliders 22, 23 engage and are moved forwardly or outwardly together along inwardly slanting portions of the respective cam trackways 20A and 20B so that the wrap yarn feeder 18 is radially moved outwardly (FIG. 9) and the yarn guide 32 passes across and above the knitting needles 3 and in advance of the selected needles to form the wrap pattern.

Figure 10:
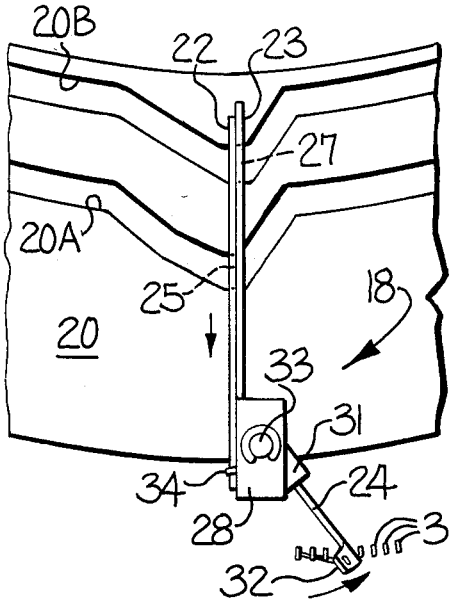
Figure 13:
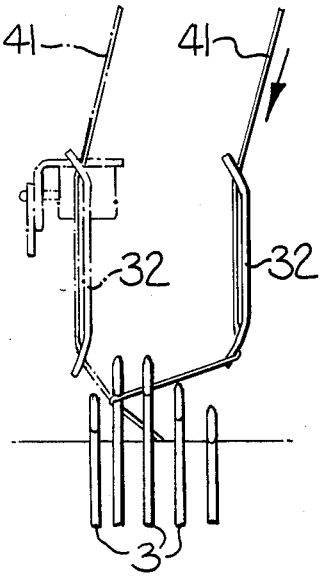
FIG. 13 is a schematic fragmentary elevational view showing the arcuate movement of the wrapping arm along the outside of the needles.

When the second slider 23 has moved to its outermost position, as shown in FIG. 10, further outer movement is imparted to the slider 22 by the deeper cam track 20A so that the first slider 22 is moved outwardly, relative to the second slider 23, and counterclockwise movement is imparted to the control pin 34 to swing the wrapping arm 24 in an arcuate path of travel in accordance with the direction of the arrow so that the wrap yarn 41 is wrapped across the front or outer side of the raised pattern needles 3. These raised needles 3 which are wrapped by the wrap yarn 41, as shown in FIG. 13, are then lowered to the knitting position and knit the wrap yarn 41 with the body yarn to produce a walewise extending pattern, which in the present instance is illustrated as being two needle wales wide.

Figure 11:
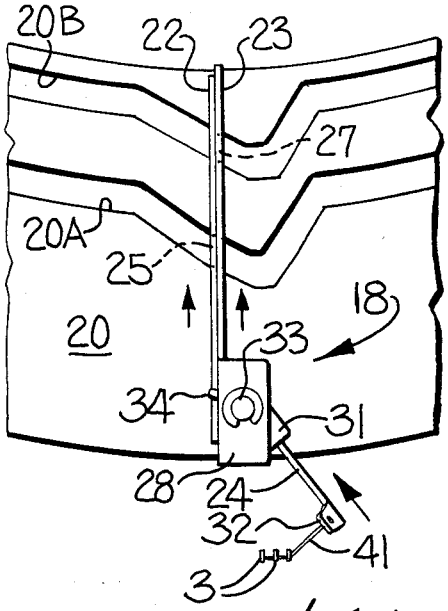

With further rotation of the slider dial 16, as shown in FIG. 11, the first and second sliders 22, 23 are drawn inwardly by the inwardly extending portions of the cam tracks 20A, 20B and the outer end of the yarn guide 32 moves inside of the circle of needles 3. The wrap yarn 41 is thus directed inwardly to the rear side of the knitting needles 3 and extends from the last needle to knit the wrap yarn to the yarn guide 32. FIG. 13 illustrates the manner in which a pair of selected needles 3 is raised after the yarn guide 32 is moved outwardly and swings from the dash-dot line position to the solid line position so that the wrap yarn 41 extends across inside of the raised needles 33 and wrapped around the front sides of the needles 3 before the selected needles are lowered to the knitting position.

Figure 12:
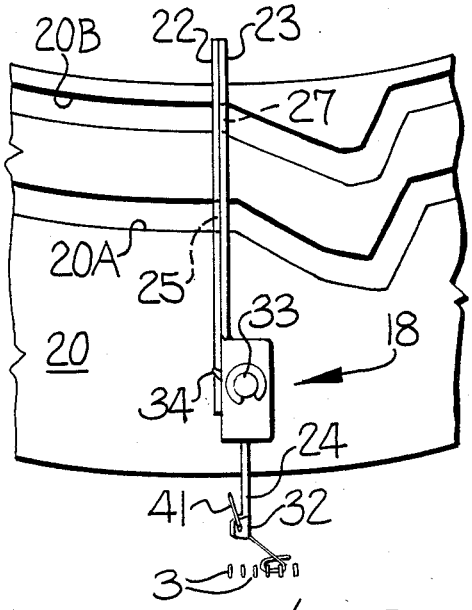

With further rotative movement of the slider dial 16, as indicated in FIG. 12, the wrap yarn feeder 18 is further moved inwardly and the first slider 22 is moved inwardly relative to the second slider 23. This relative movement of the first slider 22 relative to the second slider 23 causes the control pin 34 to be moved in a clockwise direction to arcuately swing the wrapping arm 24 back to a position substantially in alignment with the first and second sliders 22, 23 and in position to begin another wrapping operation.

Figure 14:
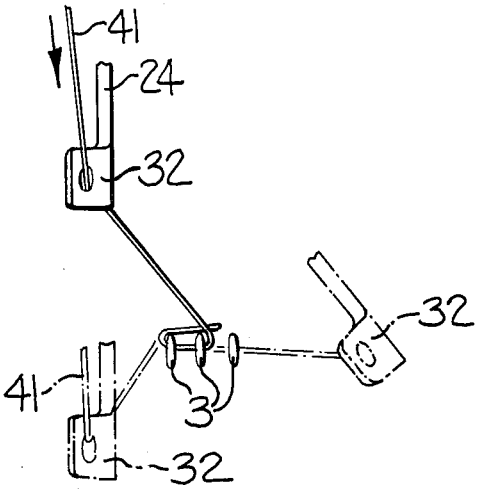
FIG. 14 is a schematic fragmentary plan view illustrating the various positional movements of the outer end of the wrapping arm relative to the selected needles to form the wrap pattern.

The relative movement of the wrap yarn feeder 18 relative to the selected needles 3, which knit the wrap yarn, is schematically illustrated in the plan view of FIG. 14. In FIG. 14, the relative positions of the yarn guide 32 are illustrated as it first moves outwardly across the circle needle, then swings in an arcuate path in a counterclockwise direction, and finally moves back inside of the needles 3 before being returned to the solid line innermost position.

The shape and position of the cam tracks 20A, 20B can be varied, according to the pattern being knit to operate the wrap yarn feeding device 18 to provide a wide variety of different patterns at the feeding locations around the circular knitting machine. The width of the wrap pattern can be varied by raising different numbers of needles to a position to have the wrap yarn wrapped thereabout and an inlay pattern can be provided by raising the selected knitting needles to a tuck position to receive the wrap yarn.

It is to be noted that the first and second sliders 22, 23, and the wrap yarn feeder 18 controlled thereby, are all narrow in width and define a narrow oblong configuration. This narrow oblong configuration permits a large number of the wrap yarn feeding devices to be positioned close to each other around the dial 16 so that wrap patterns may be formed at very small intervals in the walewise direction in the fabric being knit. Since the second slider 23 controls the inward and outward positions of the wrap yarn feeder 18 and the first slider 22 controls the arcuate movement thereof, the inward and outward movements can be varied independently of the arcuate movements to produce a wide variety of wrap knit patterns in the fabric.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A wrap yarn feeding device for wrapping walewise extending yarns about selected groups of needles of a circular series of needles in a circular knitting machine of the type including a rotary needle cylinder, said wrap yarn feeding device comprising a radially slotted dial coaxial and rotatable with said needle cylinder, first and second cooperating sliders supported for radial sliding movement in the slots of said dial, a yarn wrapping arm having an inner end pivotably supported about a vertical axis by said second slider, said wrapping arm having an outer end including yarn guide means to receive and to wrap the yarn about said selected group of needles, said second slider being operative to move said wrapping arm in a radial path extending across the needle circle, said first slider being operative to move said wrapping arm in an arcuate path about its axis, and pattern means in said dial for imparting such operative movement to said first and second sliders.

2. A wrap yarn feeding device according to claim 1 wherein said first and second sliders are supported for radial reciprocation in a single slot of said dial.

3. A wrap yarn feeding device according to claim 2 including pivot means supporting said wrapping arm for pivotal movement on the outer end of said second slider.

4. A wrap yarn feeding device according to claim 3 wherein each of said first and second sliders include operating butts extending downwardly therefrom.

5. A wrap yarn feeding device according to claim 4 wherein said pattern means comprises cams in said dial and engageable with said operating butts of said first and second sliders.

6. A wrap yarn feeding device according to claim 5 wherein said cams include a first cam track engageable with said operating butts on said first sliders for controlling the radial movement of said first sliders, and a second cam track engageable with said operating butts on said second sliders for controlling the radial movement of said second sliders.

7. A wrap yarn feeding device according to claim 3 wherein said pivot means includes a pivot support block supported on the outer end of said second slider, a control pin having an inner end fixed in one side of said pivot support block, a slot in the outer end portion of said second slider and through which said control pin projects, and a recess in the outer end portion of said first slider, the outer end portion of said control pin being positioned in said recess of said first slider so that arcuate movement is imparted to said yarn wrapping arm with radial movement of said first slider relative to said second slider.

8. A wrap yarn feeding device according to claim 3 wherein said pivot means includes a pivot support block supported on the outer end of said second slider, a control pin having an inner end fixed in one side of said pivot support, a slot in the outer end portion of said second slider and through which said control pin projects, said first slider being positioned for sliding movement between said second slider and said pivot support block, and a hole in the outer end portion of said first slider and through which said control pin projects so that arcuate movement is imparted to said yarn wrapping arm with radial movement of said first slider relative to said second slider.

9. A wrap yarn feeding device according to claim 3 wherein said pivot means includes a pivot support block supported on the outer end of said second slider and having a horizontal groove extending along one side thereof, a control pin fixed in a vertical position in said pivot support block and having a portion extending through said horizontal groove, and horizontally extending bifurcated control member on the outer end portion of said first slider, said bifurcated control member being positioned in said horizontal groove of said pivot support block and on each side of said vertical control pin so that arcuate movement is imparted to said yarn wrapping arm with radial movement of said first slider relative to said second slider.

* * * * *